US011892265B1

(12) United States Patent
Chu et al.

(10) Patent No.: US 11,892,265 B1
(45) Date of Patent: Feb. 6, 2024

(54) ANTI DRY FIRE TRIGGER DEVICE

(71) Applicant: Man Kung Enterprise Co., Ltd., Taichung (TW)

(72) Inventors: Fu-Hui Chu, Taichung (TW); Ching-Chi Hung, Taichung (TW)

(73) Assignee: Man Kung Enterprise Co., Ltd., Taichung (TW)

( * ) Notice: Subject to any disclaimer, the term of this patent is extended or adjusted under 35 U.S.C. 154(b) by 0 days.

(21) Appl. No.: 17/977,101

(22) Filed: Oct. 31, 2022

(51) Int. Cl.
*F41B 5/12* (2006.01)
*F41A 17/22* (2006.01)
*F41B 5/14* (2006.01)

(52) U.S. Cl.
CPC ..... *F41B 5/12* (2013.01); *F41A 17/22* (2013.01); *F41B 5/1469* (2013.01)

(58) Field of Classification Search
CPC ..... F42B 5/12
See application file for complete search history.

(56) References Cited

U.S. PATENT DOCUMENTS 5,596,976 A * 1/1997 Waiser ..... F41B 5/12 124/40
5,598,829 A * 2/1997 Bednar ..... F41B 5/12 124/40
5,649,520 A * 7/1997 Bednar ..... F41B 5/12 124/40
5,884,614 A * 3/1999 Darlington ..... F41B 5/12 124/35.1
7,770,567 B1 * 8/2010 Yehle ..... F41A 17/46 124/40
9,435,605 B2 * 9/2016 McPherson ..... F41B 5/12
9,494,380 B1 * 11/2016 Yehle ..... F41A 17/46
10,215,520 B1 * 2/2019 Liu ..... F41B 5/12
10,281,230 B2 * 5/2019 Khoshnood ..... F41B 5/12
10,401,117 B1 * 9/2019 Rowzie, Jr. ..... F41A 19/06

* cited by examiner

*Primary Examiner* — John A Ricci
(74) *Attorney, Agent, or Firm* — Best & Flanagan LLP

(57) ABSTRACT

An anti dry fire trigger device contains: a holder, a fixer, a string hook, a connection trigger, a safety switch, and an engagement element. The holder includes a channel, a slidable actuation element, and an accommodation groove having two defining orifices. The fixer includes a push portion, a limitation portion, and a first rotatable coupling portion. The string hook includes a hooking portion, an abutting portion, and a second rotatable coupling portion. The connection trigger rotatably includes a fastening portion and a driving portion. The safety switch slidably includes two slidable posts configured to limit the safety switch on an opening position and a closing position. The engagement element slidably is connected with the safety switch and includes a defined portion.

10 Claims, 14 Drawing Sheets

ANTI DRY FIRE TRIGGER DEVICE

BACKGROUND OF THE INVENTION

Field of the Invention

The present invention relates to a trigger device, and more particularly to an anti dry fire trigger device of a crossbow.

Description of the Prior Art

A conventional crossbow contains a body and a limb. A rear end of the body is provided with a stock, and a front end of the stock is provided with a trigger device. The trigger device includes a holder, a safety switch, a string hook, and a trigger. The trigger device further includes an aiming sight element. The limb is curved, fixed adjacent to a front end of the body, and crossed with the body. A bowstring is defined between two ends of the limb. When in use, the bowstring is pulled back to tighten and to engage with the trigger device, and an arrow is placed on the body and abuts against the bowstring, then a user aims at the target by using the aiming sight, pulls the trigger of the trigger device so that the bowstring removes from the trigger device, and the arrow is pushed by the bowstring to shoot.

Although the conventional trigger device of the crossbow is applied to trigger the arrow, the arrow will be shot after triggering the trigger carelessly by pushing a safety element. Furthermore, when the bowstring is hooked on the string hook and the arrow is not placed in the trigger device after being pulled, the bowstring removes from the string hook to shoot idly in case the user triggers the trigger carelessly, and a pulling force cannot be transformed into a shooting speed of the arrow and spreads to the crossbow to damage the limb and the bowstring, thus reducing a service life of the crossbow and injuring the user and related staffs near to the user.

With reference to FIGS. 10-14, the conventional anti dry fire trigger device is received in a trigger apparatus and contains: a casing 91, and the casing 91 includes a first segment 911, a second segment 912, a bottom 913 defined between the first segment 911 and the second segment 912, an accommodation chamber 914 formed in the casing 91, a slot 915 defined in the first segment 911 and communicating with the accommodation chamber 914, two elongated holes 916 horizontally formed on a peripheral side of the casing 91 and communicating with the accommodation chamber 914, wherein the bottom 913 has an opening 9131 communicating with the accommodation chamber 914. The conventional anti dry fire trigger device further contains a trigger assembly 92 accommodated in the accommodation chamber 914 and includes an engagement element 921, a trigger 922, a safety slide 923, a coupling sheet 924, a resilient element 925, and a locating projection 926. The engagement element 921 is rotatably received in the accommodation chamber 914 and its one end exposes outside the opening 9131, the trigger 922 is rotatably received in the accommodation chamber 914 and is adjacent to the slot 915, wherein the trigger 922 rotates in the accommodation chamber 914 to engage with an end of the engagement element 921. When the trigger 922 does not rotate, it is spaced a distance from the engagement element 921. The safety slide 923 is received in the accommodation chamber 914 and corresponds to the two elongated holes 916, and two slidable posts 9231 extend out of the two elongated holes 916. The coupling sheet 924 is slidably received in the accommodation chamber 914 and stacks with the trigger 922. The safety slide 923 slides to push the coupling sheet 924 to move. The coupling sheet 924 has a through orifice 9241 defined on an end thereof and corresponding to the second segment 912, and the accommodation chamber 914 accommodates a shaft 9141 adjacent to the through orifice 9241 of the end of the coupling sheet, two ends of the resilient element 925 are fitted with the shaft 9141 and the through orifice 9241. The locating projection 926 is rotatably received in the accommodation chamber 914 and is located beside the slot 915, and after the coupling sheet 924 moves to the locating projection 926 to limit a rotation of the locating projection 926. After the locating projection 926 release the coupling sheet 924, the locating projection 926 rotates and extends out of the slot 915. The safety slide 923 moves to the first segment 911 and push the coupling sheet 924 to move so that the coupling sheet 924 pushes the resilient element 925 and limits the rotation of the locating projection 926, thus forming a triggering mode. When the trigger apparatus is in the triggering mode and the arrow of the crossbow is replaced, the safety slide 923 is switched to move toward the second segment 912, and after the coupling sheet 924 releases the safety slide 923, the coupling sheet 924 is pulled by the resilient element 925 to slide toward the second segment 912, thus releasing the coupling sheet 924 to limit the rotation of the locating projection 926. After the locating projection 926 rotates to the slot 915, the locating projection 926 stops an idle trigger to avoid an injury to a user.

The locating projection 926 of the conventional anti dry fire trigger device is pushed by the resilient element to rotate, and a part of the locating projection 926 extends out of the slot 915 to limit and stop a bowstring 93, thus avoiding the bowstring 93 impact the user's hand or a triggering danger when removing the bow and the arrow. Such an operation is obtained by using the two slidable posts 9231 to push the coupling sheet 924 to move, and the resilient element 925 pushes the coupling sheet 924 to move, thus causing complicated structure, troublesome assembly, and high fabrication cost.

The present invention has arisen to mitigate and/or obviate the afore-described disadvantages.

SUMMARY OF THE INVENTION

The primary object of the present invention is to provide an anti dry fire trigger device which is configured to avoid an idle trigger of a crossbow and a damage of a limb and an arrow string of the crossbow to protect a user and related staffs near the user, thus enhancing using safety, obtaining simply structure and assembly, reducing fabrication cost, and achieving easy maintenance.

To provide above-mentioned objects, an anti dry fire trigger device provided by the present invention contains: a holder, a fixer, a string hook, a connection trigger, a safety switch, and an engagement element.

The holder includes a front end, a rear end, a channel extending backward from a middle section of a front end of the holder, and an accommodation groove defined on a rear side of the channel in the holder. The accommodation groove has two defining orifices formed on at least one of two sides of the accommodation groove.

The fixer is rotatably connected adjacent to a front end of the holder, and the fixer includes a push portion and a stop portion which are formed in a direction of the fixer, a limitation portion and a first rotatable coupling portion which are defined opposite to the push portion and the stop portion. The fixer is rotatably connected with the holder by using the first rotatable coupling portion, and a first spring is defined between the fixer and the holder so that the fixer is pushed by the first spring to urge the push portion of the fixer to extend into the channel and the limitation portion is configured to limit the holder.

The string hook is rotatably connected in the holder located on a rear side of the fixer, the string hook includes a hooking portion formed on a first end thereof, an abutting portion formed on a second end of the string hook, a second rotatable coupling portion defined between the hooking portion and the abutting portion, such that the string hook is rotatably connected with the holder by using the second rotatable coupling portion, and a second spring is defined between the string hook and the holder so that the string hook is pushed by the second spring and the hooking portion of the string hook removes from the channel in a normal state.

The connection trigger is rotatably connected proximate to a bottom of the holder, the connection trigger includes a fastening portion formed on a first end of the connection trigger, and the connection trigger includes a third rotatable coupling portion, such that the connection trigger is rotatably connected with the holder by using the third rotatable coupling portion, and the connection trigger is not triggered in the normal state.

The safety switch is slidably received in the accommodation groove, and the safety switch includes two slidable posts extending from at least one side of two sides of the safety switch into the two defining orifices of the holder so that the safety switch is limited on an opening position and a closing position to switch.

The engagement element is slidably received in the holder, a first end of the engagement element connected with the safety switch, and the engagement element includes a defined portion extending from a second end thereof so that the engagement element is switched to move forward and rearward with the safety switch. When the defining portion of the engagement element is stopped by the push portion of the fixer, the safety switch is limited to not slide to the opening position, thus obtaining anti dry fire trigger. When the push portion of the fixer is pushed upward by the arrow to drive the fixer to rotate, and the stop portion of the fixer does not engage with the engagement element to remove the engagement element from the stop portion of the fixer, thus sliding the safety switch to the opening position.

DETAILED DESCRIPTION OF THE PREFERRED EMBODIMENTS

Figure 1:
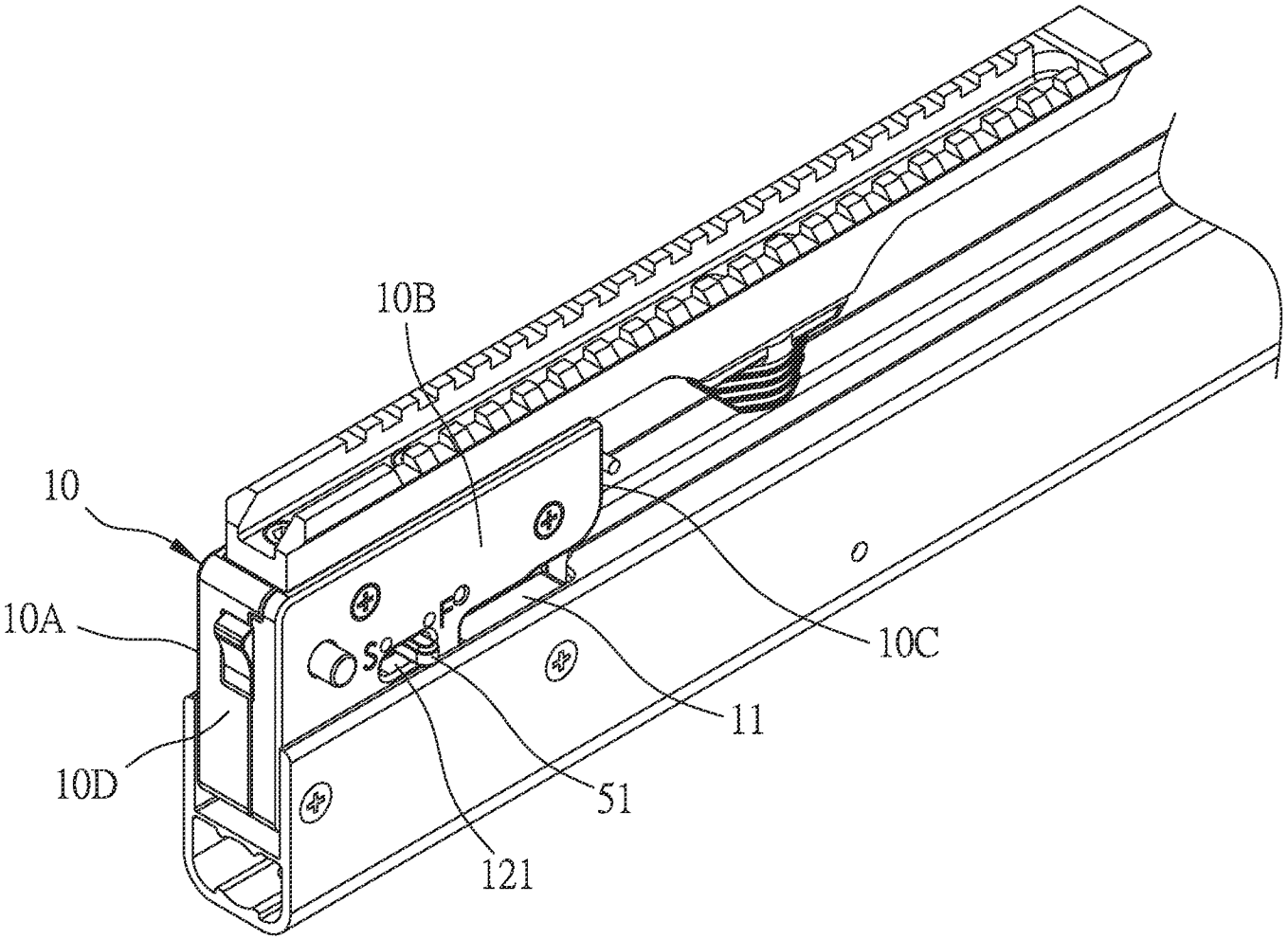
FIG. 1 is a perspective view showing the assembly of an anti dry fire trigger device according to a preferred embodiment of the present invention.
Figure 2:
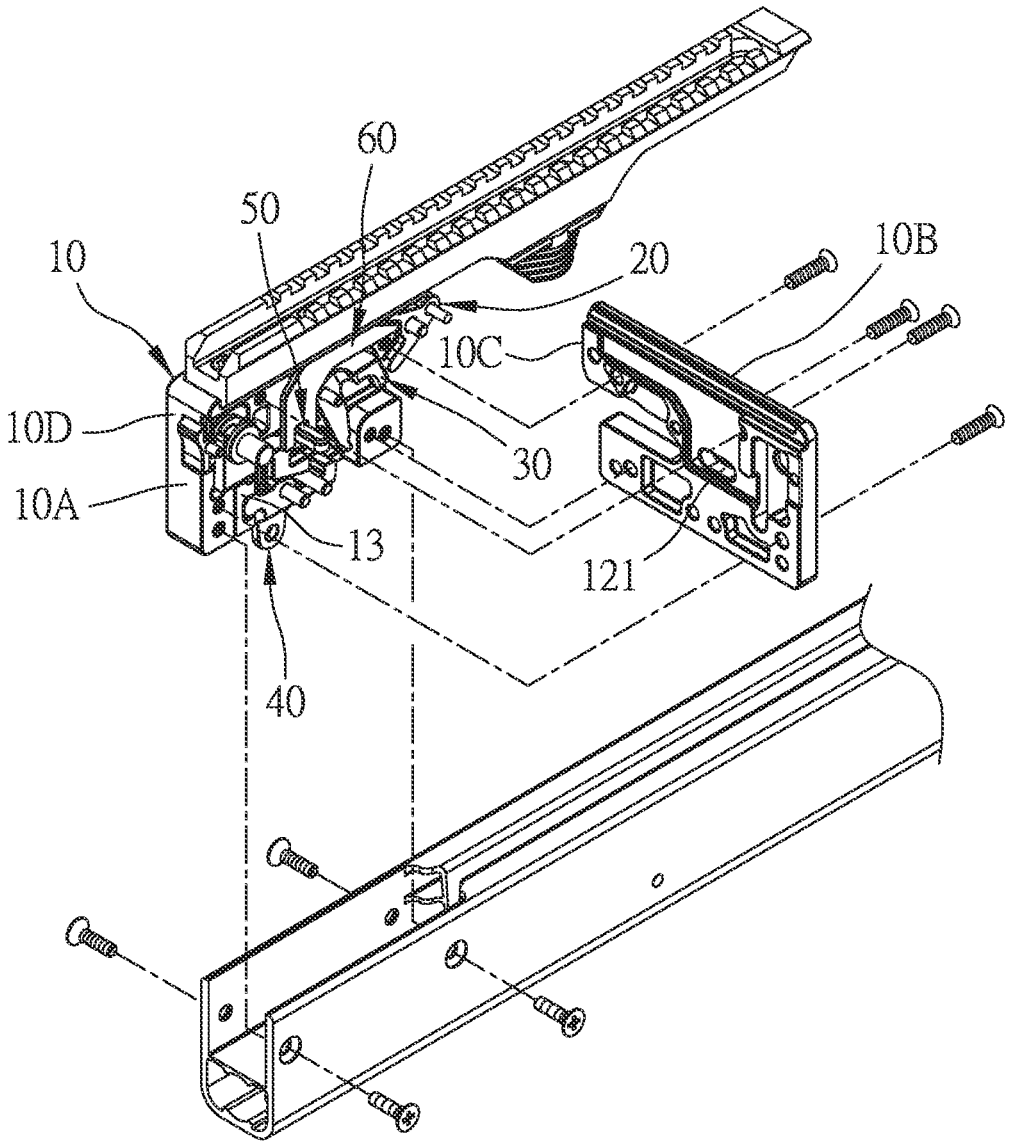
FIG. 2 is a perspective view showing the exploded components of the anti dry fire trigger device according to the preferred embodiment of the present invention.
Figure 3:
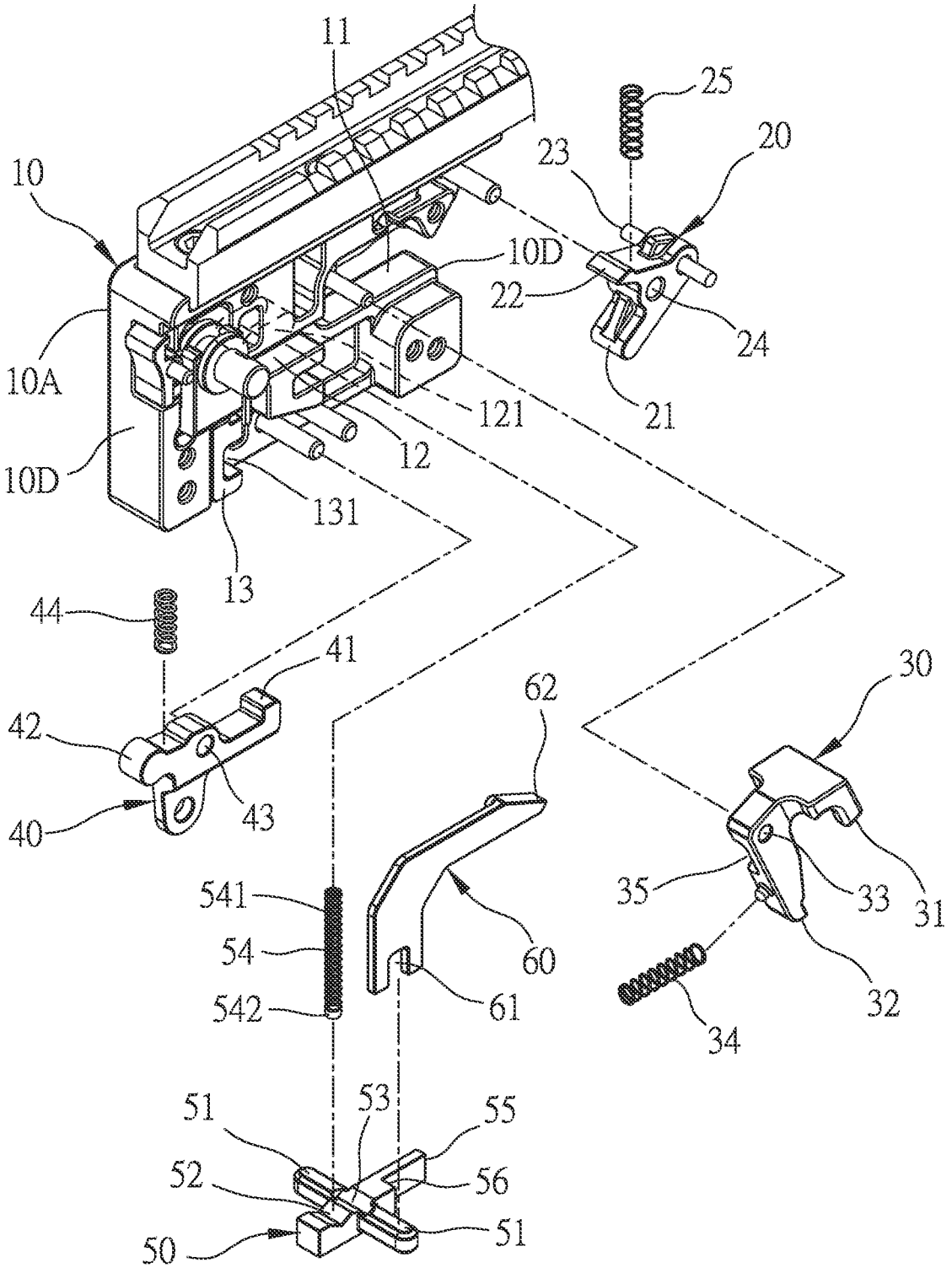
FIG. 3 is another perspective view showing the exploded components of the anti dry fire trigger device according to the preferred embodiment of the present invention.
Figure 4:
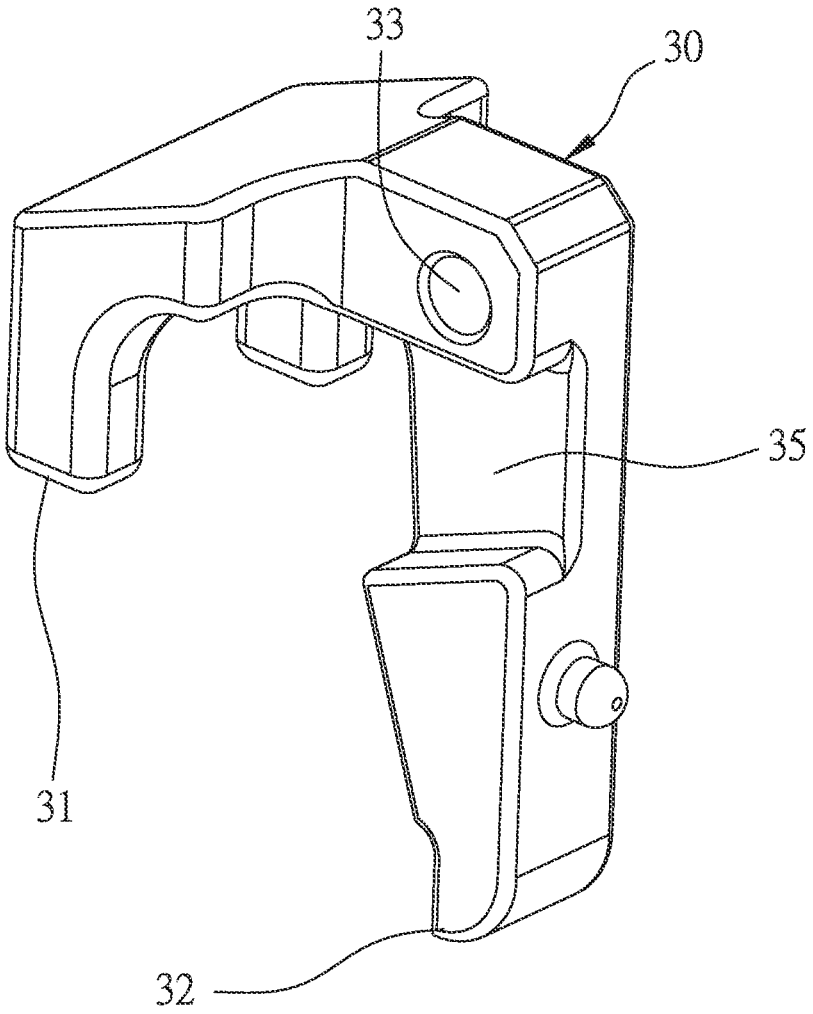
FIG. 4 is a perspective view showing the assembly of a string hook of the anti dry fire trigger device according to the preferred embodiment of the present invention.
Figure 5:
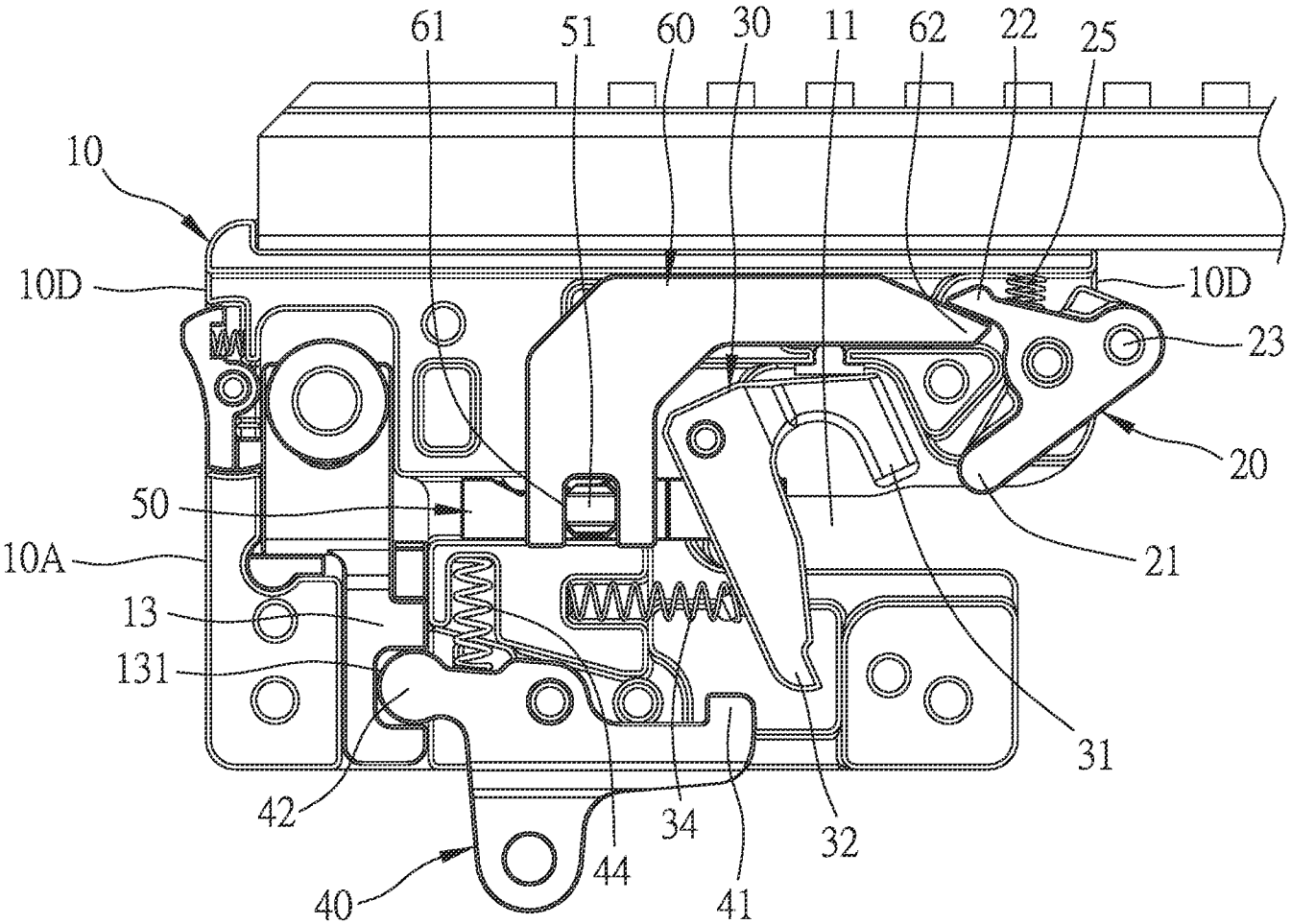
FIG. 5 is a side plan view showing the assembly of the anti dry fire trigger device according to the preferred embodiment of the present invention.

The present invention will be clearer from the following description when viewed together with the accompanying drawings, which show, for purpose of illustrations only, a preferred embodiment in accordance with the present invention.

With reference to FIGS. 1 to 5, an anti dry fire trigger device according to a preferred embodiment of the present invention comprises: a holder 10, a fixer 20, a string hook 30, a connection trigger 40, a safety switch 50, and an engagement element 60.

The holder 10 includes a first lid 10A, a second lid 10B covered with the first lid 10A, a front end 10C and a rear end a channel 11 extending backward from a middle section of a front end 10C of the holder 10, and an accommodation groove 12 defined on a rear side of the channel 11 in the holder wherein the accommodation groove 12 has two defining orifices 121 formed on two sides of the accommodation groove 12, and the holder 10 further includes a slidable actuation element 13 received and sliding upward and downward in a rear side of the accommodation groove 12, wherein the slidable actuation element 13 has a trench 131 defined therein.

The fixer 20 is rotatably connected adjacent to a front end of the holder 10, and the fixer 20 includes a push portion 21 and a stop portion 22 which are formed in a direction of the fixer 20, and the stop portion 22 is located above the push portion 21, a limitation portion 23 and a first rotatable coupling portion 24 which are defined opposite to the push portion 21 and the stop portion 22 (wherein the first rotatable coupling portion 24 is a hole in this embodiment). The fixer 20 is rotatably connected with the holder 10 by using the first rotatable coupling portion 24 so that the fixer 20 is rotated along the first rotatable coupling portion 24, wherein a first spring 25 is defined between the fixer 20 and the holder 10, and the fixer 20 is pushed by the first spring 25 to urge the push portion 21 of the fixer 20 to extend into the channel 11 and the limitation portion 23 is configured to limit the holder 10.

The string hook 30 is rotatably connected in the holder 10 and is located on a rear side of the fixer 20, wherein the string hook 30 includes a hooking portion 31 formed on a first end thereof, an abutting portion 32 formed on a second end of the string hook 30, a second rotatable coupling portion 33 (wherein the second rotatable coupling portion 33 is a hole in this embodiment) defined between the hooking portion 31 and the abutting portion 32, such that the string hook 30 is rotatably connected with the holder 10 by using the second rotatable coupling portion 33. A second spring 34 is defined between the string hook 30 and the holder 10 so that the string hook 30 is pushed by the second spring 34 and the hooking portion 31 of the string hook 20 removes from the channel 11 in a normal state. The abutting portion 32 extends below the channel 11, and the string hook 30 includes a dodge notch 35 defined on a rear side thereof and gradually increasing a width of the dodge notch 35 forward.

The connection trigger 40 is rotatably connected proximate to a bottom of the holder 10, the connection trigger 40 includes a fastening portion 41 formed on a first end thereof, and the connection trigger 40 includes a driving portion 42 formed on a second end thereof, such that the driving portion 42 of the connection trigger 40 engages with and drives the trench 131 of the actuation element 13. A third rotatable coupling portion 43 (wherein the third rotatable coupling portion 43 is a hole in this embodiment) is defined between the hooking portion 41 and the driving portion 42, such that the connection trigger 40 is rotatably connected with the holder 10 by using the third rotatable coupling portion 43. A third spring 44 is defined between the connection trigger 40 and the holder 10 so that the connection trigger 40 is pushed by the third spring 44, wherein the connection trigger 40 is not triggered in the normal state, and when the connection trigger 40 is triggered, the connection trigger 40 actuates the actuation element 13 to move upward.

Figure 7:
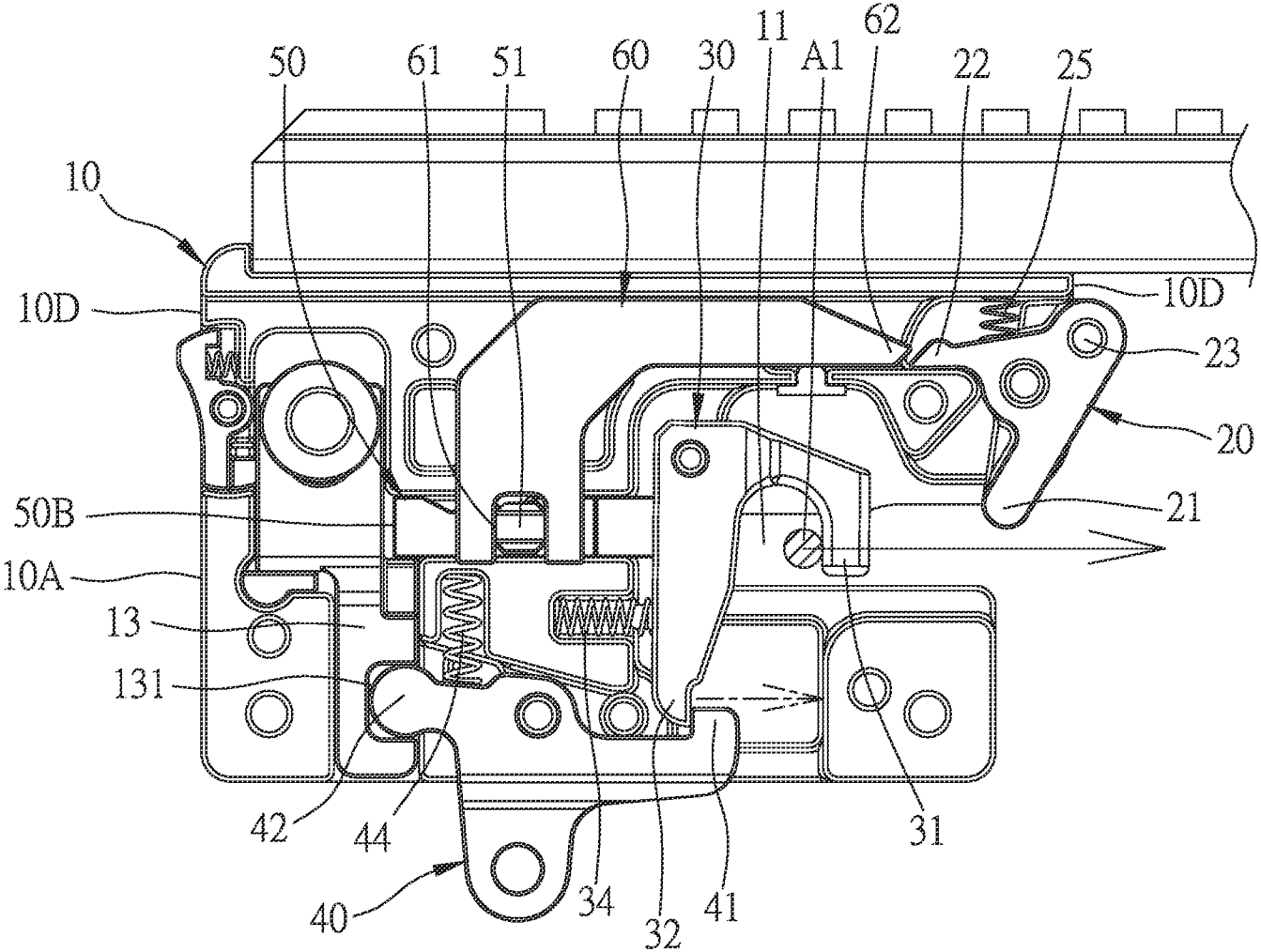
FIG. 7 is another side plan view showing the operation of the anti dry fire trigger device according to the preferred embodiment of the present invention.
Figure 8:
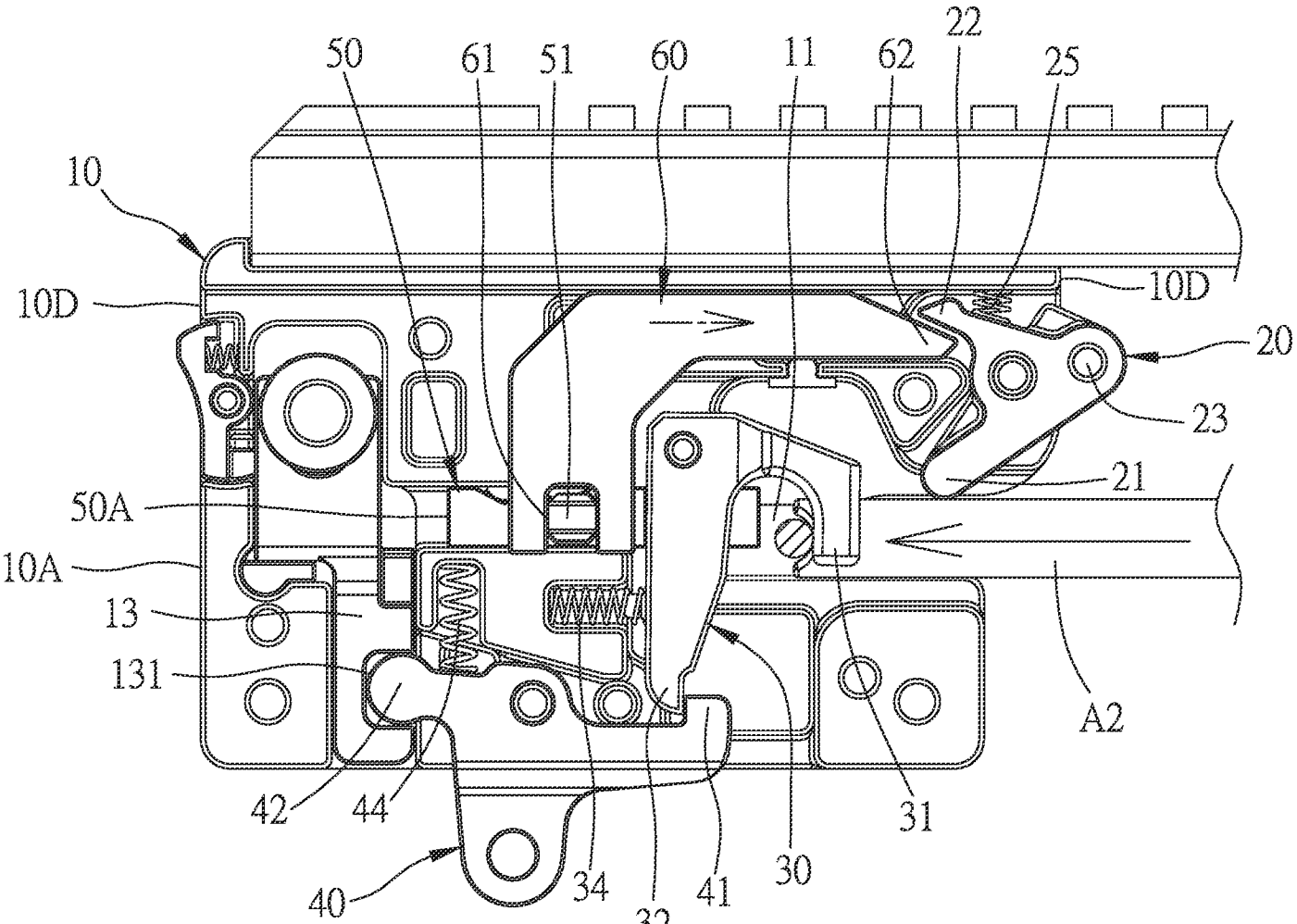
FIG. 8 is also another side plan view showing the operation of the anti dry fire trigger device according to the preferred embodiment of the present invention.
Figure 9:
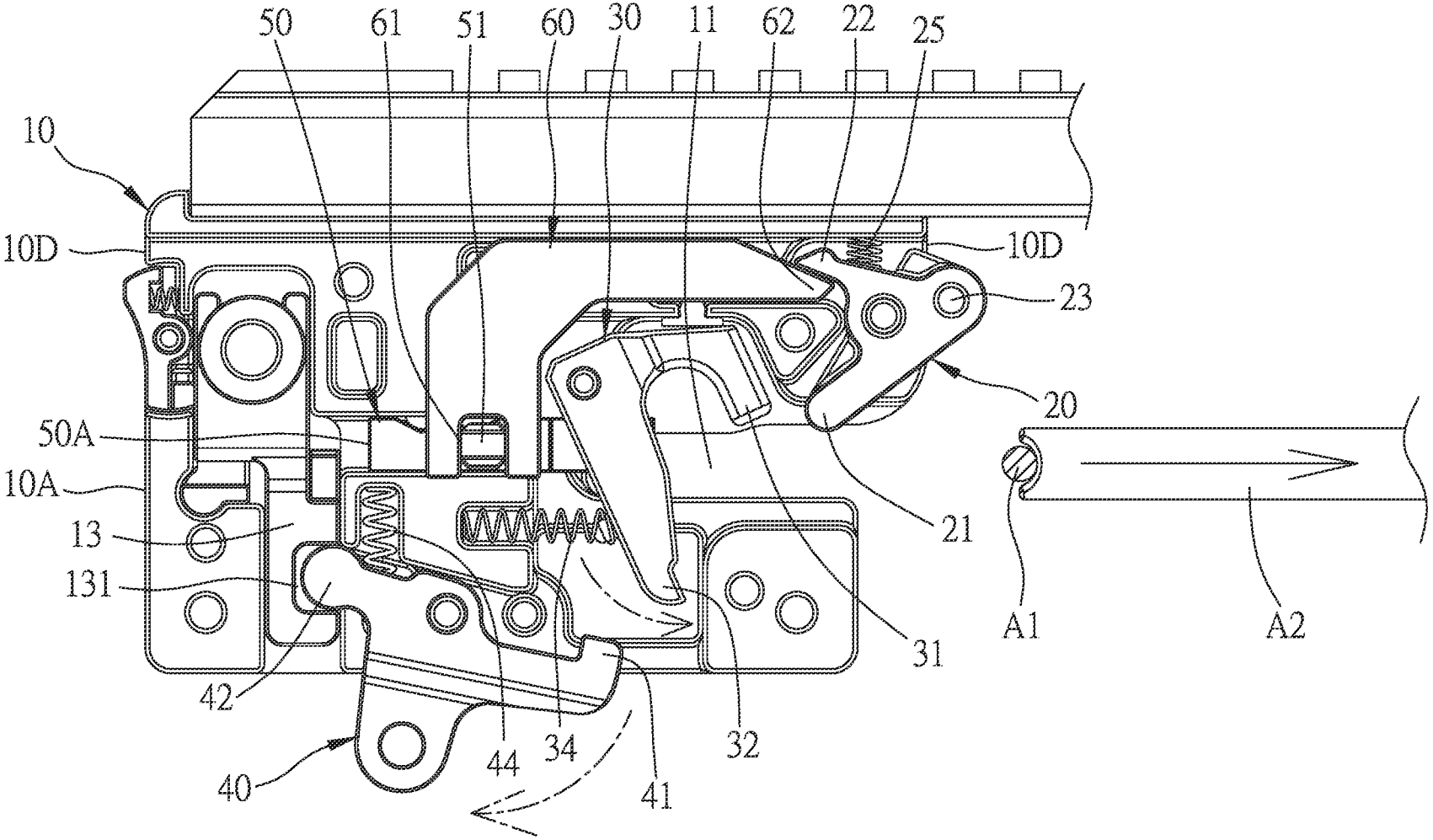
FIG. 9 is still another side plan view showing the operation of the anti dry fire trigger device according to the preferred embodiment of the present invention.
Figure 10:
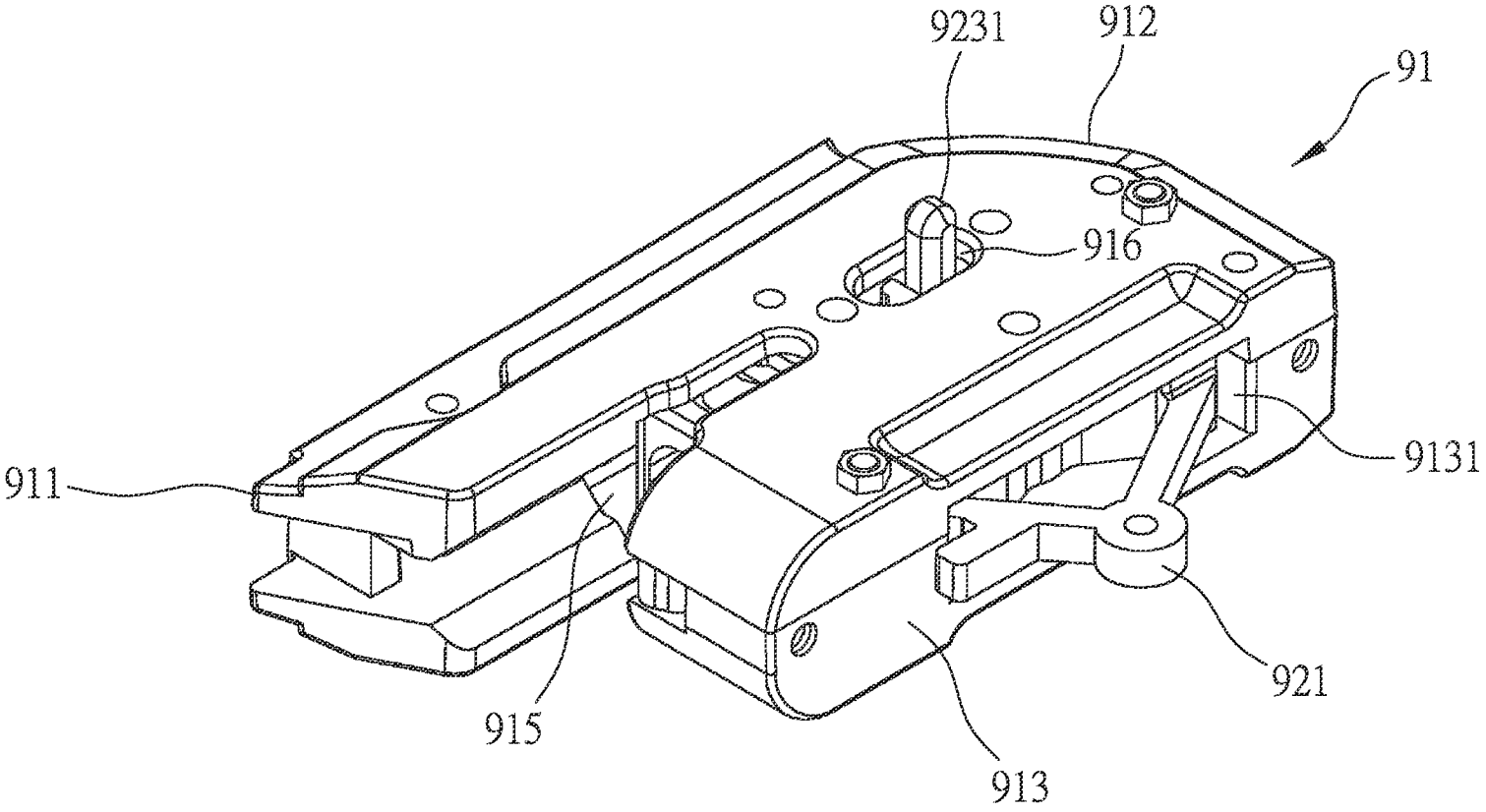
FIG. 10 PRIOR ART
FIG. 10 is a perspective view of a conventional anti dry fire trigger device.
Figure 11:
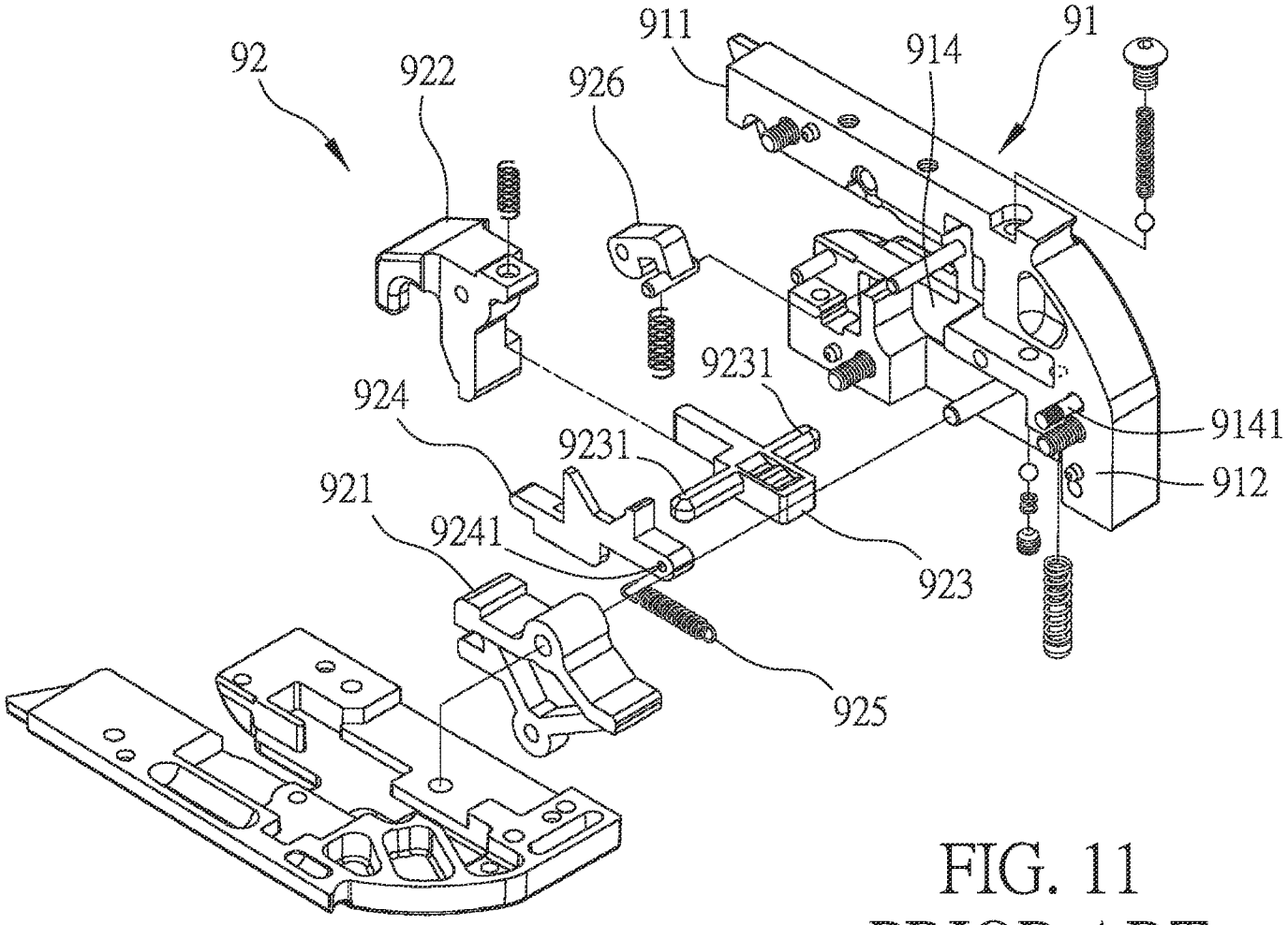
FIG. 11 PRIOR ART
FIG. 11 is a perspective view shoeing the exploded components of the conventional anti dry fire trigger device.
Figure 12:
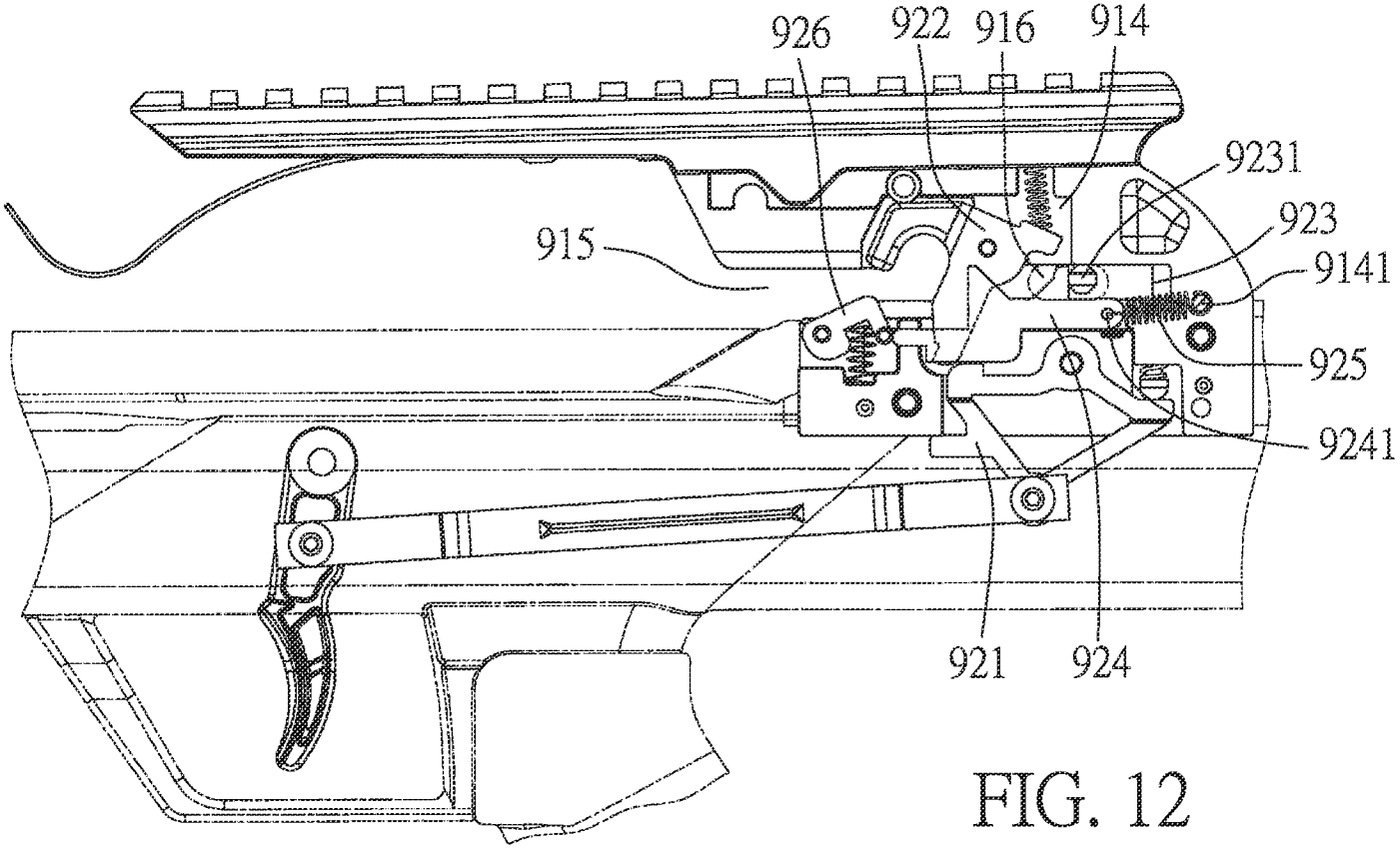
FIG. 12 PRIOR ART
FIG. 12 is a side plan view showing the assembly of the conventional anti dry fire trigger device.
Figure 13:
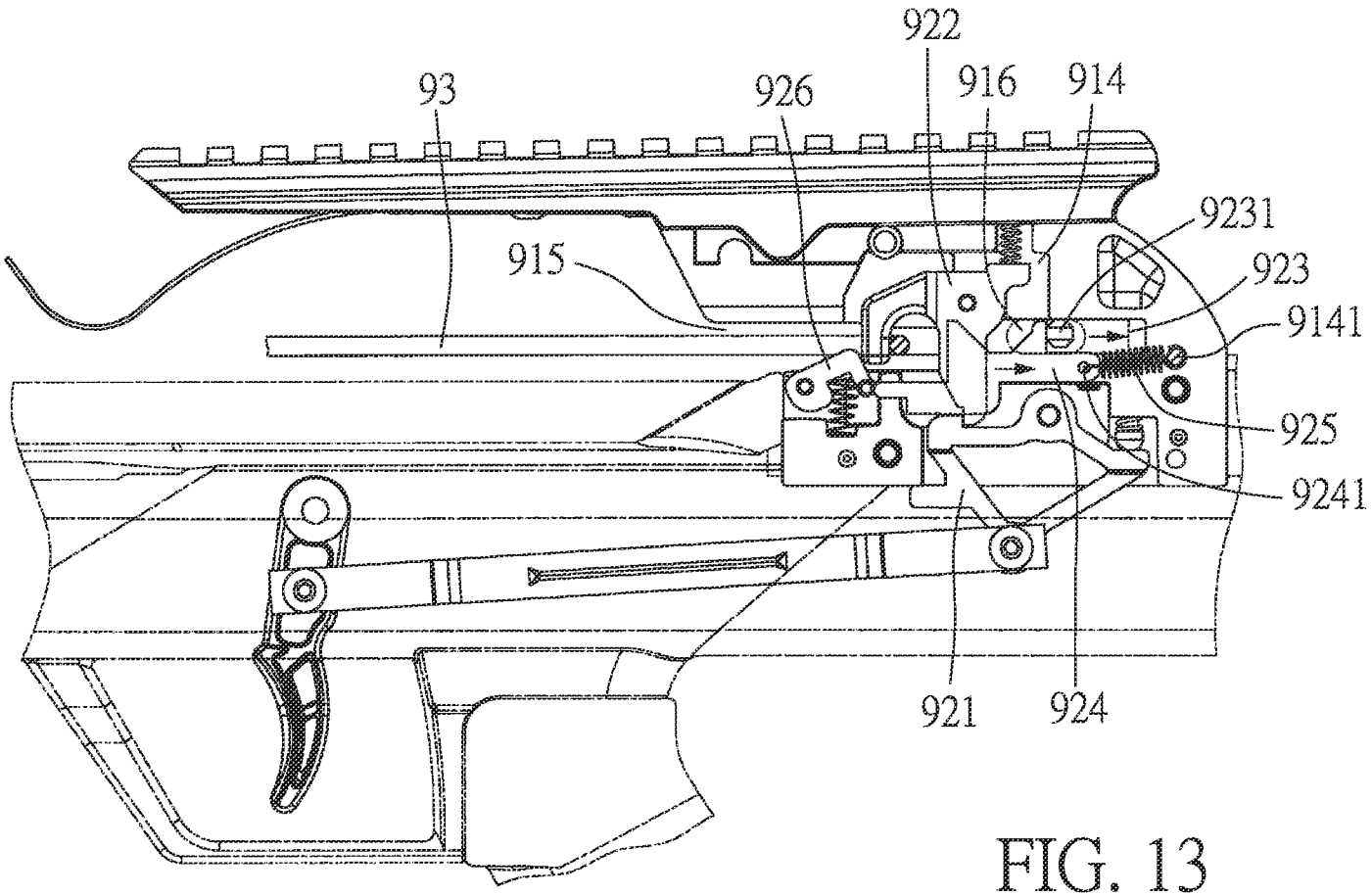
FIG. 13 PRIOR ART
FIG. 13 is a side plan view showing the operation of the conventional anti dry fire trigger device.
Figure 14:
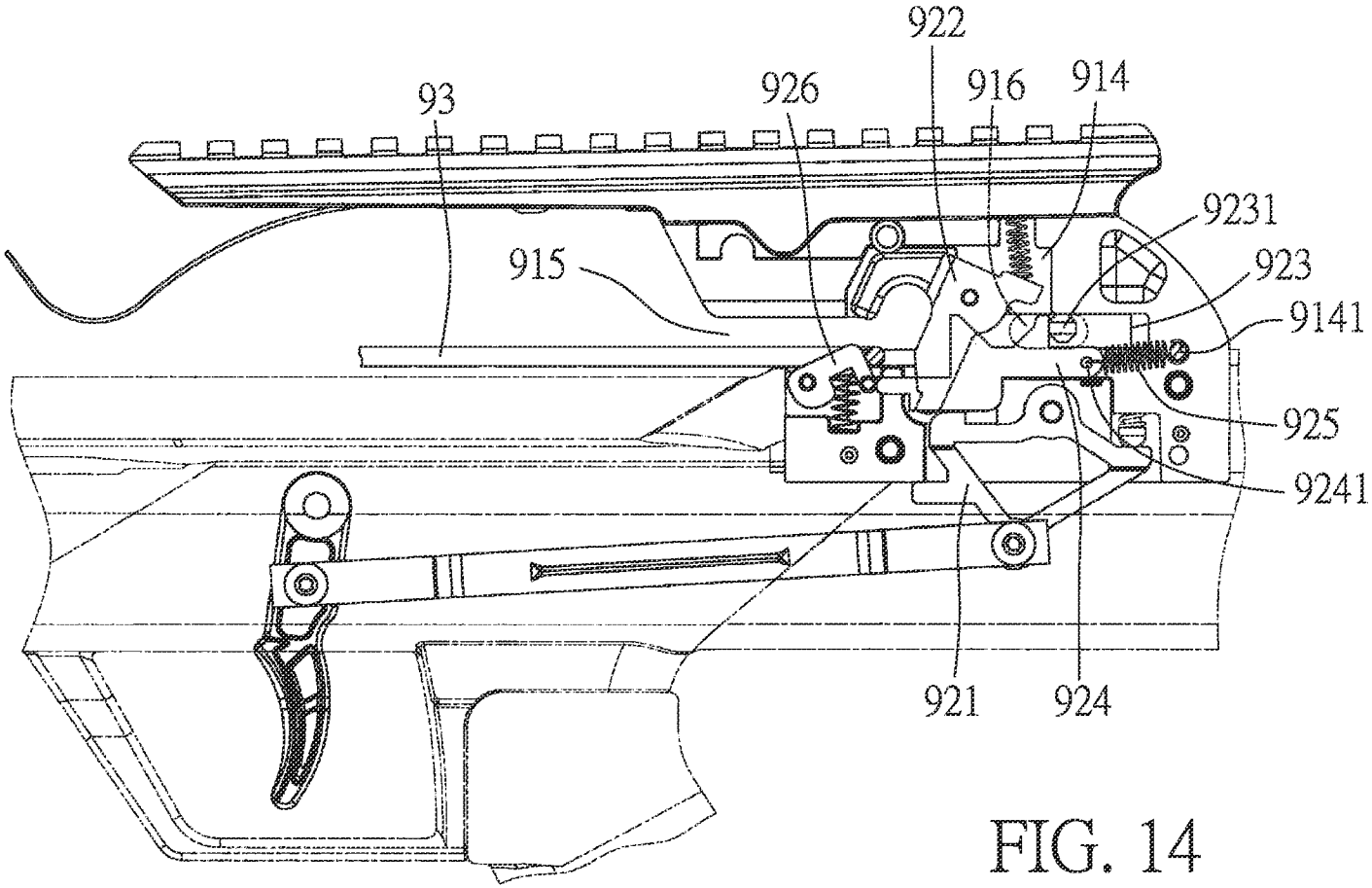
FIG. 14 PRIOR ART
FIG. 14 is another side plan view showing the operation of the conventional anti dry fire trigger device.

The safety switch 50 is slidably received in the accommodation groove 12, and the safety switch 50 includes two slidable posts 51 extending from two sides of the safety switch 50 into the two defining orifices 121 of the holder 10 so that the safety switch 50 is limited on an opening position 50A (as shown in FIGS. 8 and 9) and a closing position 50B (as shown in FIG. 7) to switch, wherein the safety switch 50 includes a first locating slot 52 and a second locating slot 53 which are configured to abut against a positioning assembly 54, and the positioning assembly 54 has a fourth spring 541 and a steel ball 542 connected with a distal end of the fourth spring 541, wherein a position of the first locating slot 52 abutting against the positioning assembly 54 is the opening position 50A of the safety switch 50, a position of the second locating slot 53 abutting against the positioning assembly 54 is the closing position 50B of the safety switch 50, when the safety switch 50 is located on the closing position 50B, the slidable actuation element 13 is stopped by the safety switch 50 to not slide upward so that the connection trigger 40 is not pressed to trigger. Furthermore, the safety switch 50 includes an insertion 55 and a fixing portion 56 extending from an end thereof which face to the string hook 30, and the insertion 55 is received in the dodge notch 35 of the string hook 30.

The engagement element 60 is formed in an inverted-L shape and is slidably received in the holder 10, the engagement element 60 includes a joining portion 61 extending from a first end thereof, and the engagement element 60 includes a defined portion 62 extending from a second end thereof, wherein the joining portion 61 is a notch and is engaged with the two slidable posts 51 of the safety switch 50 so that the engagement element 60 moves forward and backward with the safety switch 50.

Figure 6:
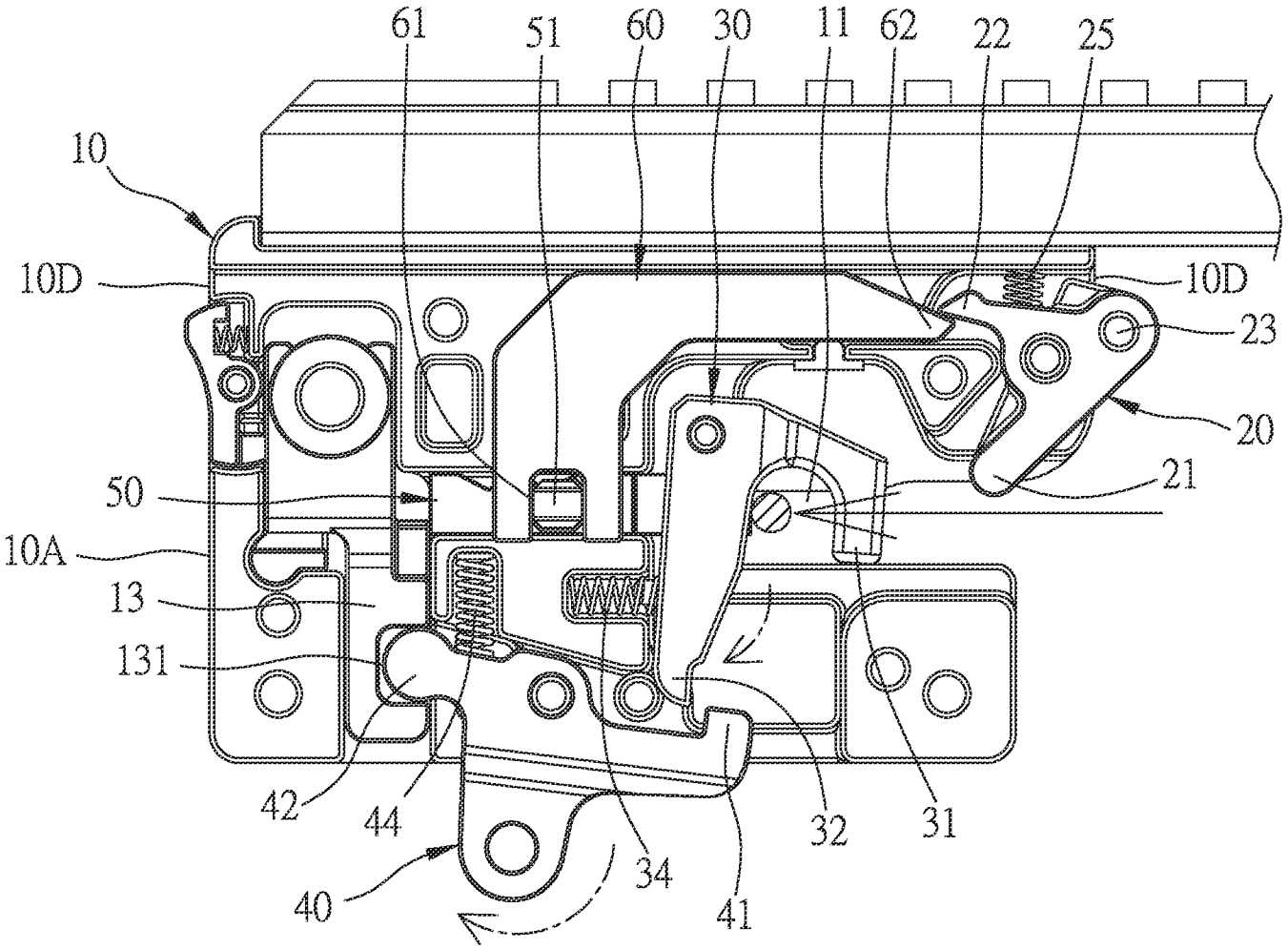
FIG. 6 is a side plan view showing the operation of the anti dry fire trigger device according to the preferred embodiment of the present invention.

Referring to FIGS. 6 and 7, when shooting an arrow, the string A1 is pulled rearward to hook on the hooking portion 31 of the string hook 30, and the abutting portion 32 of the string hook 30 is engaged by the fastening portion 41 of the connection trigger 40. In the meantime, the string A1 does not engaged with the arrow, and the stop portion 22 of the fixer 20 stops the defined portion 62 of the engagement element 60 so that the engagement element 60 limits the safety switch 50 not to switch to the opening position 50A from the closing position 50B, thus limiting rotation of the connection trigger 40 to avoid an dry fire trigger.

When placing the arrow A2 in the channel 11, as illustrated in FIG. 8, the arrow A2 is located on a shooting position, the push portion 21 of the fixer 20 is pushed upward by the arrow A2 to drive the fixer 20 to rotate, and the stop portion 22 of the fixer 20 does not stop the defined portion 62 of the engagement element 60 so that the safety switch 50 is switch to the opening position 50A from the closing position 50B, and the slidable actuation element 13 is not stopped by the safety switch 50 to slide upward. When desiring to trigger the connection trigger 40, as shown in FIG. 9, the connection trigger 40 actuates the actuation element 13 to move upward, the fastening portion 41 of the connection trigger 40 removes from the abutting portion 32 of the string hook 30, and the string hook 30 is pushed by the second spring 34 to remove the hooking portion 31 of the string hook 30 from the channel 11, hence the string A1 detaches from the hooking portion 31 of the string hook 30, and the arrow A2 is pushed by the string A1 to shoot.

Accordingly, the anti dry fire trigger device of the present invention has advantages as follows:

the anti dry fire trigger device is configured to avoid an idle trigger of the crossbow and a damage of a limb and an arrow string of the crossbow to protect a user and related staffs near the user, thus enhancing using safety, obtaining simply structure and assembly, reducing fabrication cost, and achieving easy maintenance.

While various embodiments in accordance with the present invention have been shown and described, it is clear to those skilled in the art that further embodiments may be made without departing from the scope of the present invention.

What is claimed is:

1. An anti dry fire trigger device comprising:

a holder including a front end, a rear end, a channel extending backward from a middle section of a front end of the holder, and an accommodation groove defined on a rear side of the channel in the holder, wherein the accommodation groove has two defining orifices formed on at least one of two sides of the accommodation groove;

a fixer rotatably connected adjacent to a front end of the holder, and the fixer including a push portion and a stop portion which are formed in a direction of the fixer, a limitation portion and a first rotatable coupling portion which are defined opposite to the push portion and the stop portion, wherein the fixer is rotatably connected with the holder by using the first rotatable coupling portion, a first spring is defined between the fixer and the holder so that the fixer is pushed by the first spring to urge the push portion of the fixer to extend into the channel and the limitation portion is configured to limit the holder;

a string hook rotatably connected in the holder located on a rear side of the fixer, wherein the string hook includes a hooking portion formed on a first end thereof, an abutting portion formed on a second end of the string hook, a second rotatable coupling portion defined between the hooking portion and the abutting portion, such that the string hook is rotatably connected with the holder by using the second rotatable coupling portion, and a second spring is defined between the string hook and the holder so that the string hook is pushed by the second spring and the hooking portion of the string hook removes from the channel in a normal state;

a connection trigger rotatably connected proximate to a bottom of the holder, the connection trigger including a fastening portion formed on a first end of the connection trigger, and the connection trigger including a third rotatable coupling portion, such that the connection trigger is rotatably connected with the holder by using the third rotatable coupling portion, and the connection trigger is not triggered in the normal state;

a safety switch slidably received in the accommodation groove, and the safety switch including two slidable posts extending from at least one side of two sides of the safety switch into the two defining orifices of the holder so that the safety switch is limited on an opening position and a closing position to switch; and an engagement element slidably received in the holder, a first end of the engagement element connected with the safety switch, and the engagement element includes a defined portion extending from a second end thereof so that the engagement element is switched to move forward and rearward with the safety switch; wherein when the defining portion of the engagement element is stopped by the push portion of the fixer, the safety switch is limited to not slide to the opening position, thus obtaining anti dry fire trigger; when the push portion of the fixer is pushed upward by the arrow to drive the fixer to rotate, and the stop portion of the fixer does not engage with the engagement element to remove the engagement element from the stop portion of the fixer, thus sliding the safety switch to the opening position.

2. The anti dry fire trigger device as claimed in claim 1, wherein the holder further includes a slidable actuation element received and sliding upward and downward in a rear side of the accommodation groove; the connection trigger includes a driving portion formed on a second end thereof, such that the driving portion engages with and drives the slidable actuation element.

3. The anti dry fire trigger device as claimed in claim 2, wherein the slidable actuation element has a trench defined therein, and the connection trigger is engaged with the trench by using the driving portion.

4. The anti dry fire trigger device as claimed in claim 2, wherein when the safety switch is located on the closing position, the slidable actuation element is stopped by the safety switch to not slide upward so that the connection trigger is not pressed to trigger.

5. The anti dry fire trigger device as claimed in claim 1, wherein the engagement element is formed in an inverted-L shape.

6. The anti dry fire trigger device as claimed in claim 1, wherein a first lid and a second lid covered with the first lid.

7. The anti dry fire trigger device as claimed in claim 1, wherein a third spring is defined between the connection trigger and the holder so that the connection trigger is pushed by the third spring, wherein the connection trigger is not triggered in the normal state.

8. The anti dry fire trigger device as claimed in claim 1, wherein the string hook includes a dodge notch defined on a rear side thereof and gradually increasing a width of the dodge notch forward, the safety switch includes an insertion extending from an end thereof which faces to the string hook, and the insertion is received in the dodge notch of the string hook.

9. The anti dry fire trigger device as claimed in claim 1, wherein the safety switch includes a first locating slot and a second locating slot which are configured to abut against a positioning assembly, and the positioning assembly has a fourth spring and a steel ball connected with a distal end of the fourth spring, wherein a position of the first locating slot abutting against the positioning assembly is the opening position of the safety switch, a position of the second locating slot abutting against the positioning assembly is the closing position of the safety switch.

10. The anti dry fire trigger device as claimed in claim 1, wherein the engagement element includes a joining portion extending from a first end thereof, and the joining portion is a notch, wherein the joining portion is engaged with the two slidable posts of the safety switch.

* * * * *